US008661865B2

(12) United States Patent
Loreti

(10) Patent No.: US 8,661,865 B2
(45) Date of Patent: Mar. 4, 2014

(54) PROGRAMMABLE CYLINDER LOCK AND KEYS FOR THE OPERATION THEREOF

(75) Inventor: Alberto Loreti, Antrodoco (IT)

(73) Assignee: Rielda Serrature s.r.l., Fiumicino (IT)

( * ) Notice: Subject to any disclaimer, the term of this patent is extended or adjusted under 35 U.S.C. 154(b) by 0 days.

(21) Appl. No.: 13/695,830

(22) PCT Filed: Apr. 13, 2011

(86) PCT No.: PCT/EP2011/001948

§ 371 (c)(1),
(2), (4) Date: Nov. 2, 2012

(87) PCT Pub. No.: WO2011/137974

PCT Pub. Date: Nov. 10, 2011

(65) Prior Publication Data

US 2013/0047688 A1 Feb. 28, 2013

(30) Foreign Application Priority Data

May 6, 2010 (IT) ..... TO10A0381

(51) Int. Cl.
*E05B 29/04* (2006.01)

(52) U.S. Cl.
USPC ..... 70/492; 70/383; 70/384; 70/493; 70/495

(58) Field of Classification Search
USPC ..... 70/337–343, 368, 382–385, 492–496
See application file for complete search history.

(56) References Cited

U.S. PATENT DOCUMENTS

| | | | | |
|---|---|---|---|---|
| 4,376,382 | A * | 3/1983 | Raymond et al. | 70/338 |
| 4,412,437 | A * | 11/1983 | Smith | 70/338 |
| 4,712,399 | A | 12/1987 | Mattossovich | |
| 4,966,021 | A * | 10/1990 | Boag | 70/383 |
| 6,119,495 | A * | 9/2000 | Loreti | 70/340 |
| 7,007,528 | B2 * | 3/2006 | Chong et al. | 70/492 |
| 7,584,635 | B2 * | 9/2009 | Gan et al. | 70/338 |
| 7,836,739 | B2 * | 11/2010 | Huang et al. | 70/360 |
| 8,117,876 | B2 * | 2/2012 | Mathachan | 70/492 |
| 8,316,676 | B2 * | 11/2012 | Chiang et al. | 70/383 |
| 2005/0217330 | A1 | 10/2005 | Chong et al. | |
| 2008/0314106 | A1 * | 12/2008 | Mathachan | 70/493 |

FOREIGN PATENT DOCUMENTS

| | | |
|---|---|---|
| EP | 0 226 252 A2 | 6/1987 |
| EP | 0 900 310 B1 | 3/1999 |
| WO | 98/40589 A1 | 9/1998 |

OTHER PUBLICATIONS

International Search Report, dated Jul. 21, 2011, from corresponding PCT application.

* cited by examiner

*Primary Examiner* — Christopher Boswell
(74) *Attorney, Agent, or Firm* — Young & Thompson

(57) ABSTRACT

A programmable cylinder lock includes a stator and a cylindrical rotor mounted therein, having a keyhole and including inside the rotor key followers movable along the longitudinal and transversal directions, and locking pins movable along the longitudinal direction, the followers and locking pins forming together a number of pairs and having toothings for mutually cooperating to define the lock codification, the rotor including a stop bar cooperating with a longitudinal groove of the stator and cooperating with the locking pins, and a change bar slidingly coupled with the followers to keep them engaged with the pins and disengage them therefrom when the bar provides a lock programming position. The bar has projections facing the keyhole, and the use key has corresponding recesses to face the projections when correctly inserted in the lock, whereas the change key has a longitudinal groove extending in a position corresponding to the use key recesses.

6 Claims, 2 Drawing Sheets

PROGRAMMABLE CYLINDER LOCK AND KEYS FOR THE OPERATION THEREOF

The subject of this invention is a programmable cylinder lock, namely a lock comprising devices intended to allow the initial codification of the lock or, through a change operation, to modify the former lock codification in order to adjust the lock for being operated by a key different from the key to which the lock was formerly adapted.

More particularly, the invention concerns improvements in a kind of programmable cylinder lock which is known from the European Patents Nos. 0.226.252 and 0.900.310.

BACKGROUND OF THE INVENTION

The programmable locks of the kind to which applies the present invention and which are described in the cited documents comprise, within a rotor rotatably mounted inside the stator, a number of key followers movable along their longitudinal and transversal directions, intended to cooperate with the codification conformations of a key inserted into the rotor keyhole, and locking pins having movability along their own longitudinal directions, which are the blocking members of the lock. The key followers and the locking pins form pairs each comprising a locking pin and a key follower, and they are provided with toothings intended to mutually cooperate, in different relative positions, for determining the lock codification. A transversally displaceable stop bar, cooperating with a longitudinal stator groove, is susceptible of cooperating with recesses of the locking pins in order to immobilize the locking pins when the rotor is rotated within the stator and, as a consequence, the stop bar comes out of said groove and engages the locking pins. A transversally displaceable change bar is slidably engaged with the key followers and normally retains the key followers engaged with the locking pins, but this change bar, when it enters said stator groove, transversally displaces the key followers by disengaging the same from the locking pins, thus allowing the modification of the lock codification by replacing the former key by a new different key.

A requirement laid down for the known locks of this kind is to ensure that the codification change may be effected only by using a special change key. This gives the security that the lock codification cannot be modified or altered by mistake. Another requirement, common to all kinds of locks, is to allow an increase in the number of different keys that can be provided. Still another requirement common to all kinds of locks is to hinder the non-authorized manufacture of key copies. Several solutions have been proposed for all these problems, but in general they involve complications or constructive difficulties, thus increasing the lock size and cost.

SUMMARY OF THE INVENTION

The main object of this invention is to improve a lock of the considered kind in order to supply a simple and sure solution to the above stated problems without increasing in a noticeable manner the size, the complication and the cost of the lock.

This object is attained, according to the invention, in a lock of the stated kind, in that the stop bar has at least one protrusion facing the keyhole of the rotor intended to receive the key, and that the use key has in the side surface thereof at least one recess situated in such a way that it faces said protrusion of the stop bar when the key is correctly inserted in the lock, whereas the corresponding change key has in the side surface thereof a longitudinal groove extending in a position corresponding to said at least one recess of the use key.

In this way, when the rotor is made to rotate by means of a use key, and the stop bar comes out of the stator groove, in the presence of the correct key said projection of the stop bar enters the corresponding recess of the key and then retains the key, whereby it is not possible to take the key away from the lock and provide a change condition. On the contrary, when the rotor is made to rotate by a change key, said projection of the stop bar enters the longitudinal groove of the change key, but this groove does not hinder the key extraction for a change operation.

Moreover, if in the lock is inserted a use key whose teeth are correctly codified, but that does not have in its side surface a recess corresponding to the projection of the stop bar, this latter cannot displace in radial direction for coming out of the stator groove and thus blocks the rotor, which therefore cannot be made to rotate by that key. It follows that the presence and position of said recess of the use key are additional elements to the lock and key codification, and therefore allow to increase the number of different keys which may be provided.

Besides, because usually the non-authorized key copies are obtained by means of copying cutters that provide a correct outline of the key teeth but are not able to provide in the side surface of the key a recess so located that it places itself in front of a projection of the stop bar, it follows that the key copies suitable for operating the lock according to the invention cannot be provided by the usual equipments, and this fact seriously hinders their manufacture.

In order to increase the effectiveness of the provision according to the invention, it is of advantage that the stop bar is provided with two or more projections, and that in a corresponding manner the use keys have in their side surface two or more recesses intended to place themselves in front of said projections of the stop bar. By suitably choosing the number and position of the projections of the stop bar it is possible to increase at wish the number of different keys which may be provided.

BRIEF DESCRIPTION OF THE DRAWINGS

These and other features, objects and advantages of the subject of the present invention will more clearly appear from the following description of a preferred embodiment, being a not limiting example, with reference to the accompanying drawings, wherein.

DETAILED DESCRIPTION OF THE PREFERRED EMBODIMENTS

Figure 1:
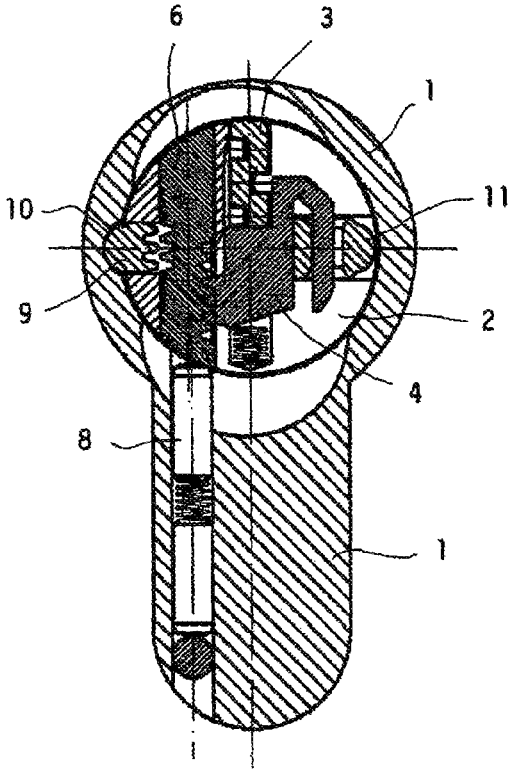
FIG. 1 represents, for the purpose of reference, a cross section of a programmable cylinder lock carried down according to the teachings of the European Patent No. 0.900.310, having inserted a key suitable for operating the lock, in the condition of insertion of the key.

At first, reference to FIG. 1 will be made in order to recall the general structure and the operation of a lock of the considered kind, for whose particulars reference is made to the cited documents.

Number 1 designates a stator inside which there is rotatably mounted a cylindrical rotor 2 susceptible of receiving in its keyhole a key 3. In the following, it will be considered as longitudinal the direction parallel to the geometrical axis of the corresponding cylindrical rotor, and will be considered as transversal the direction perpendicular to the plane of the key and the corresponding keyhole.

In rotor 2 there are mounted key followers 4, which lies in a plane perpendicular to the axis of the cylindrical rotor 2 and are movable along the longitudinal and transversal directions. The key followers 4 are provided for cooperating with the codification conformations of key 3. Moreover, in rotor 2 there are mounted locking pins 6, and each of them is coplanar with a key follower 4 and is movable along its own longitudinal direction. The locking pins 6 form the blocking member of the lock. The lock can possibly counterpins 8 mounted in stator 1.

The key followers 4 and the locking pins 6 have toothings intended to mutually cooperate, and this may take place in different relative positions in order to define the lock codification. in the position of key insertion (FIG. 1), the locking pins are free to displace along their own longitudinal direction, but a stop bar 9, displaceable in the transverse direction within rotor 2 and susceptible of cooperating with a groove 10 of stator 1, serves for immobilizing the locking pins 6 when rotor 2 is made to rotate within stator 1 and, as a consequence, the stop bar 9 comes out of said groove 10 and engages the locking pins 6.

A change bar 11 which is transversally displaceable in rotor 2 is slidingly coupled with the key followers 4, and normally the change bar 11 keeps the key followers 4 engaged with the locking pins 6 but, when said change bar 11, due to a rotation of rotor 2, comes to correspond to said groove 10 of stator 1 and enters therein, it transversally displaces the key followers 4 and disengages the same from the locking pins 6. Then, by means of the replacement of the former key 3 by a different key, it is possible to modify the lock codification.

Figure 2:
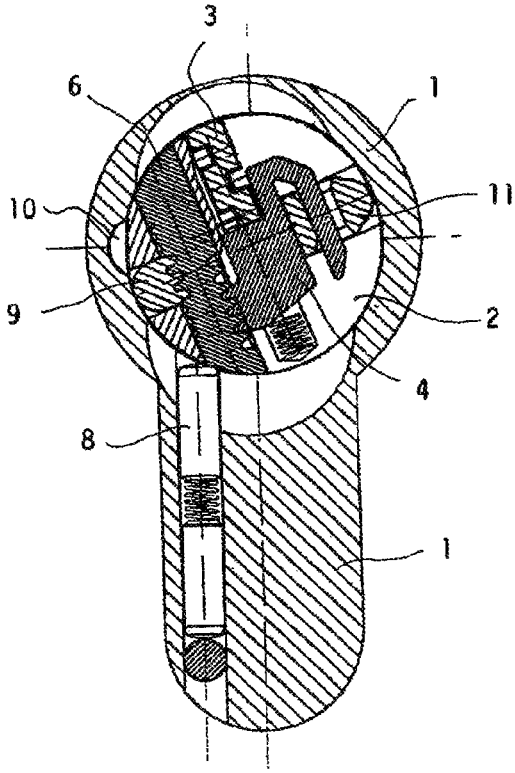
FIG. 2 shows a cross section corresponding to that of FIG. 1, but in the condition in which by means of the key the rotor has been made to rotate of a certain angle.

FIG. 2 shows that, when rotor 2 is rotated by key 3, the stop bar 9 leaves the groove 10 of stator 1 and displaces radially inwards by engaging the locking pins 6 in order to immobilize the same. Of course, this inwards displacement of the stop bar is needed for allowing the rotation of rotor 2, which would be positively prevented by the stop bar if the same would be prevented from displacing radially inwards by disengaging from the groove 10.

Figure 3:
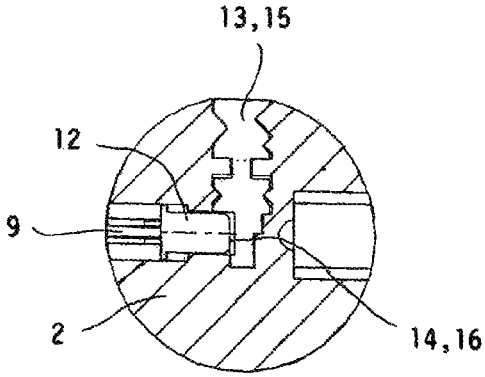
FIG. 3 shows a cross section of a lock rotor according to the invention, in the condition in which the inserted key has a recess or groove corresponding to a projection of the stop bar, and therefore it allows the radial displacement of the stop bar.
Figure 4:
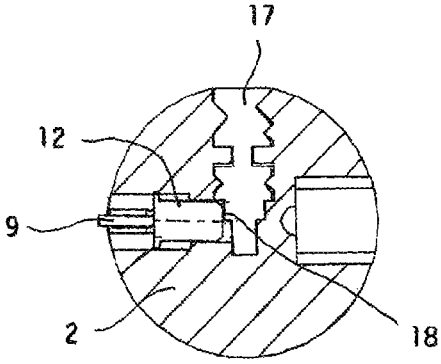
FIG. 4 shows a cross section corresponding to that of FIG. 3, but refers to the case in which the inserted key does not have a recess or groove corresponding to a projection of the stop bar, and therefore it does not allow the radial displacement of the stop bar.

In FIGS. 3 and 4, which refer to the lock according to the invention, there are represented only the rotor 2, the stop bar 9 and the key, now designated 13, 15 or 17, because the other component parts are not interested in the operation according to the invention, and they could conform to any known embodiment.

The stop bar 9 has at least a projection 12 facing the keyhole of rotor 2 intended to receive the key 13. The extension of projection 12 is such that it does not hinder the insertion of key 13 when the stop bar 9 is inserted in the groove 10 of stator 1 and is displaced outwards.

Figure 5:
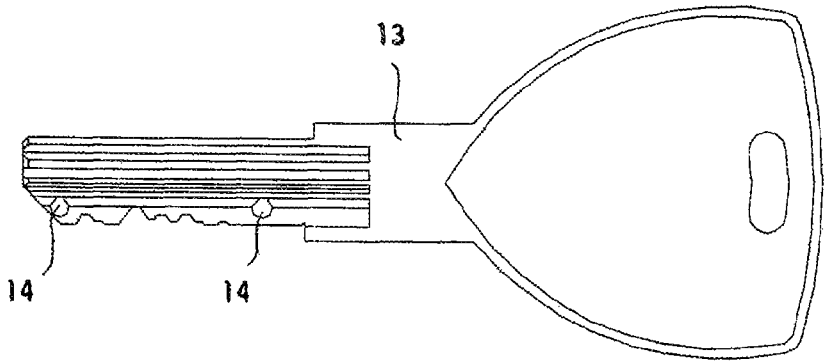
FIG. 5 shows a side view of a use key shaped according to the present invention.

The use key 13 according to the invention (FIG. 5) differs from the known keys only in that it is provided in its side surface with one or more recesses 14, which are so located that, when key 13 is inserted in the lock rotor 2, they place themselves in front of the corresponding projections 12 of the stop bar 9.

Therefore, when the key 13 causes rotor 2 to rotate, the stop bar 9 displaces radially inwards, and this displacement is not hindered because a recess 14 of key 13 faces the projection 12. Therefore the lock can be operated in the usual manner. The engagement of projection 12 of the stop bar 9 in the recess 14 of key 13 lasts in any position of rotor 2, except the position of key insertion; in this position the stop bar enters the groove 10, displaces radially outwards and the projection 12 disengages from the recess 14.

Until projection 12 remains engaged in recess 14, key 13 cannot be withdrawn from the lock. Therefore, the key cannot be extracted in the change position, and the lock codification cannot be modified by mistake.

Figure 6:
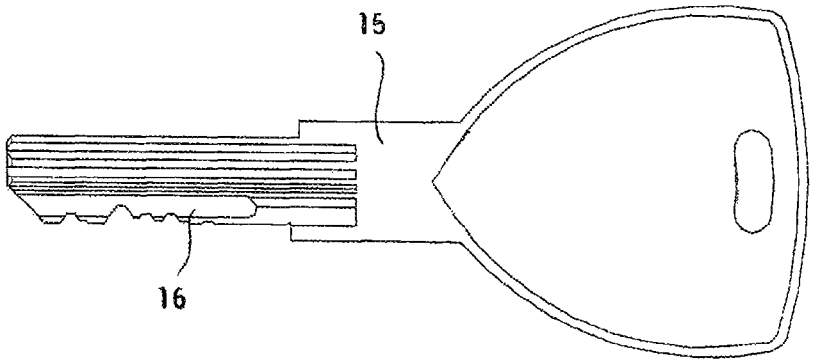
FIG. 6 shows, in a manner similar to FIG. 5, a change key suitable for the lock according to the present invention.

The change key 15 (FIG. 6) differs from the use key 13 in that, in the position corresponding to the recesses 14 of key 13, it is provided with a uninterrupted longitudinal groove 16. Therefore, when the change key 15 is inserted in the lock, the projection 12 of the stop bar 9 meets the facing groove 16 wherein it can enter, and the stop bar 9 is not hindered to radially displace inwards for coming out of the groove 10 of stator 1. Rotor 2 can freely be made to rotate by the change key 15. However, because the groove 16 is uninterrupted, the change key 15 is not retained by projection 12, and in the change position of the lock the change key can be extracted and replaced by a different change key in order to modify the lock codification.

Figure 7:
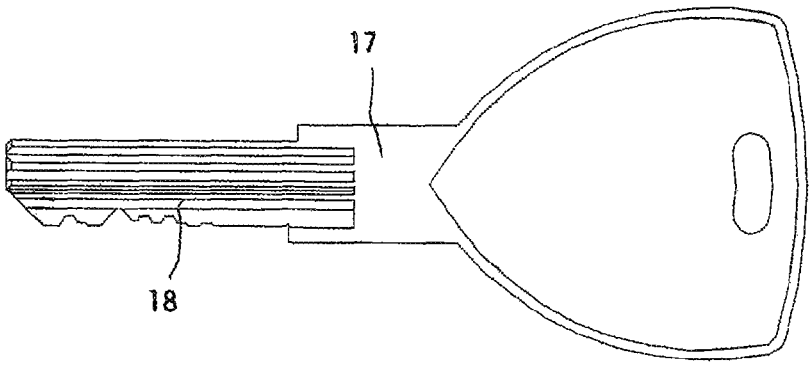
FIG. 7 shows, in a manner similar to FIG. 5, a key copy as can be manufactured by means of the usual copying cutter for keys.

If of key 13 or 15 is made a copy by using the usual copying equipments, the resulting key is like key 17 represented in FIG. 7. It is identical to the original key 13 or 15, except in that its side surface is not provided with the recesses 14 nor with the groove 16.

If this key copy is inserted in the lock rotor 2, the condition represented in FIG. 4 takes place. The projection 12 of the stop bar 9 does not find in front a recess nor a groove, but the side surface 18 of key 17. Therefore the stop bar 9 is kept unmovable in the position in which it projects from rotor 2 and is engaged in groove 10 of stator 1. So the rotor 2 cannot be rotated by the key copy 17.

As already said, by suitably choosing the number and disposition of the projections of the stop bar it is possible to attain the desired increase in the number of different keys which can be manufactured. Besides, by providing a number of projections 12 and recesses 14, the arrangement according to the invention may also be used for providing master use keys suitable for operating a number of locks whose normal use keys are suitable only for operating the corresponding lock.

In this case, a master use key is provided with recesses whose positions correspond to the positions of projections of a number of locks which are operable by normal use keys provided with recesses whose number and positions correspond to the number and positions of the projections of the stop bar of the corresponding lock.

Thanks to the application of this invention there is obtained, by simple and sure means and without in any way increasing the size, the, complexity and the cost of the lock, the safety in the preservation of the lock codification against maneuver mistakes, an increase in the number of different keys which can be provided, an obstacle to the non-authorized copy of the keys and also, if required, the possibility of producing master keys.

It is to be understood that this invention is not limited to the embodiments described and shown as examples. Several possible modifications have been pointed out in the course of the description, and others are within the ability of those skilled in the art. These modification and others, and any replacement by technically equivalent means, can be made to what has been described and shown, without departing from the spirit of the invention and the scope of this Patent as defined by the appended Claims.

The invention claimed is:

1. A system, comprising:

a programmable cylinder lock;

a use key; and a change key, wherein the programmable cylinder lock comprises a stator (1), and a cylindrical rotor (2) mounted inside the stator (1) for rotation around its own axis and having a keyhole extending in a direction of the axis for insertion of a key, and comprising inside the cylindrical rotor (2) a plurality of key followers (4) movable along longitudinal and transversal directions, adapted to cooperate with codification conformations of a key inserted into the keyhole of the cylindrical rotor (2), and a plurality of locking pins (6), movable along the longitudinal direction, forming lock blocking members, said key followers (4) and locking pins (6) forming together a plurality of pairs each including a locking pin (6) and a key follower (4) and having toothings adapted to mutually cooperate, in different relative positions, to define a lock codification, the cylindrical rotor (2) comprising a transversally displaceable stop bar (9) that cooperates with a longitudinal groove (10) of the stator (1) and that cooperates with the locking pins (6) in order to immobilize said locking pins (6) when the cylindrical rotor (2) is made to rotate within the stator (1) and the stop bar (9) comes out of said groove (10) and engages the locking pins (6), and comprising a change bar (11) which is transversally displaceable and is slidingly coupled with the key followers (4) in order to normally engage the key followers (4) with the locking pins (6), and to disengage the key followers (4) from the locking pins (6) when said change bar (11) comes into said groove (10) of the stator (1) and provides a lock programming position, wherein said stop bar (9) has at least one protrusion (12) facing the keyhole of said cylindrical rotor (2), and wherein the use key (13) has at least one recess (14) that faces said protrusion (12) of the stop bar (9) when the use key (13) is correctly inserted in the keyhole of the cylinder lock, whereas the change key (15) corresponding to the use key (13) has a longitudinal groove (16) extending in a position corresponding to said at least one recess (14) of the use key (13).

2. The system as set forth in claim 1, wherein said stop bar (9) has two or more protrusions (12), and wherein the use key (13) has recesses (14) corresponding in number and positions to said protrusions (12) of the stop bar.

3. The system as set forth in claim 1, wherein a master use key has recesses whose positions correspond to the positions of the protrusions (12) of a plurality of locks operated by different normal use keys (13) having recesses (14) corresponding in number and positions to said protrusions (12) of the stop bar (9) of the corresponding lock.

4. The system as set forth in claim 1, wherein the cylinder lock is configured such that when the cylindrical rotor (2) is made to rotate from an insertion position by the use key (13) properly fitted in the keyhole, said protrusion (12) of the stop bar (9) is caused to enter the recess (14) of the use key (13) such to retain the use key (13) in the keyhole except where the cylindrical rotor (2) is in the insertion position.

5. The system as set forth in claim 4, wherein, when the change key (15) is properly fitted in the keyhole, the protrusion (12) of the stop bar (9) meets and enters the longitudinal groove (16) such that the stop bar (9) does not prevent the change key (15) from exiting the keyhole.

6. The system as set forth in claim 1, wherein the cylinder lock is configured such that when the change key (15) is properly fitted in the keyhole, the protrusion (12) of the stop bar (9) meets and enters the longitudinal groove (16) such that the stop bar (9) does not prevent the change key (15) from exiting the keyhole.

* * * * *